United States Patent [19]

Woods et al.

[11] 3,960,333

[45] June 1, 1976

[54] FLUIDIC MILL

[76] Inventors: Verle W. Woods; Jay A. Woods, both of P.O. Box 1016, Yakima, Wash. 98907

[22] Filed: Dec. 12, 1974

[21] Appl. No.: 532,019

Related U.S. Application Data

[63] Continuation-in-part of Ser. No. 387,795, Aug. 13, 1973, abandoned.

[52] U.S. Cl. ..... 241/46.15; 241/174

[51] Int. Cl.[2] ..... B02C 15/08

[58] Field of Search ..... 241/46.15, 173, 174

[56] References Cited

UNITED STATES PATENTS

| | | | |
|---|---|---|---|
| 563,733 | 7/1896 | Behrend et al. | 241/46.15 |
| 1,260,330 | 3/1918 | Clark | 241/174 |
| 3,199,797 | 8/1965 | Eft et al. | 241/173 X |
| 3,539,115 | 11/1970 | Woods | 241/46.15 |

*Primary Examiner*—Granville Y. Custer, Jr.
*Attorney, Agent, or Firm*—Wells, St. John & Roberts

[57] ABSTRACT

A mill for pumping and grinding solid particles in a fluid medium. The particles are circulated by centrifugal forces that result from rotational movement imparted to freely rolling balls or rollers about a powered circular race assembly. The balls or rollers ride along axially spaced shoulders on the ball race assembly. Apertures between the shoulders provide fluid circulation from the area in which the balls or rollers are located to the exterior of the ball race assembly.

9 Claims, 19 Drawing Figures

FIG 11
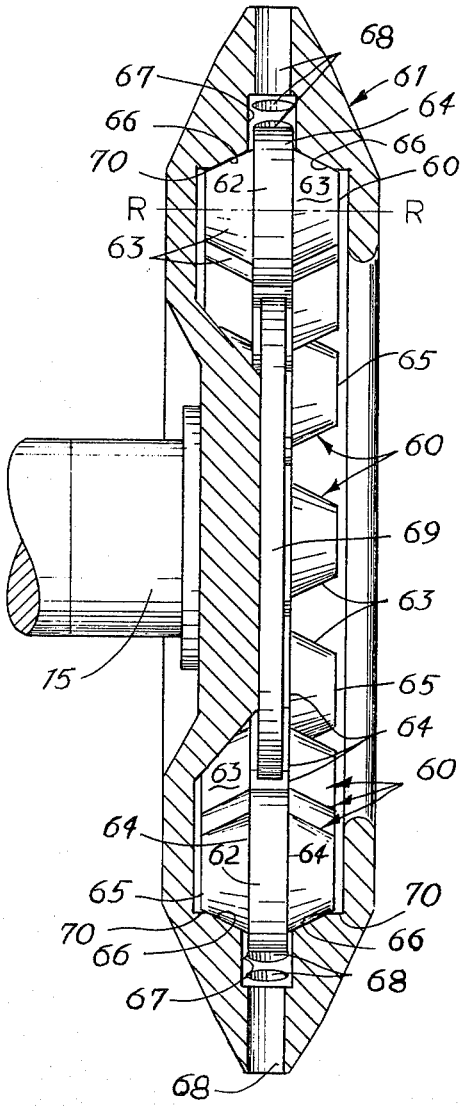
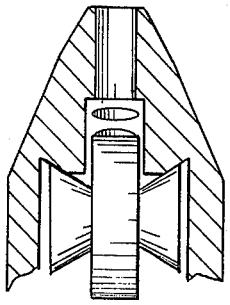
FIG 12
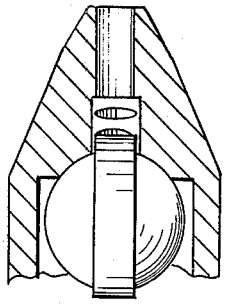
FIG 13
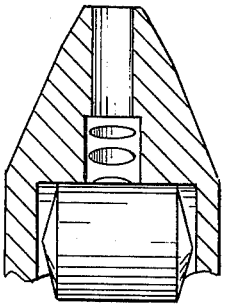
FIG 14
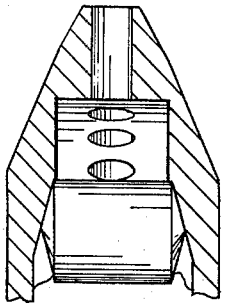
FIG 15
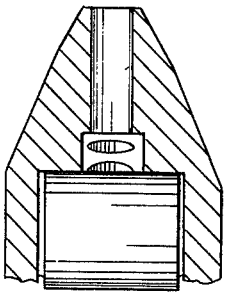
FIG 16
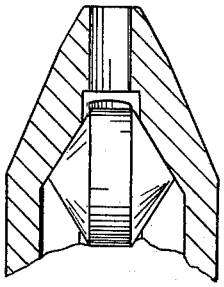
FIG 17
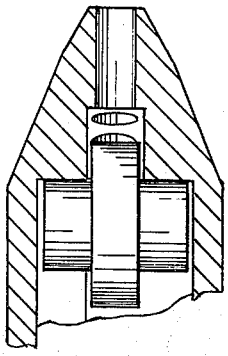
FIG 18
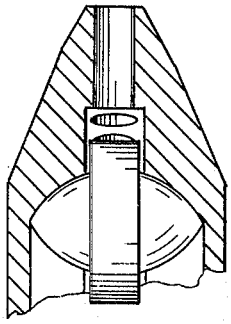
FIG 19

FLUIDIC MILL

RELATED APPLICATIONS

This is a continuation-in-part of application Ser. No. 387,795, filed Aug. 13, 1973, now abandoned.

BACKGROUND OF THE INVENTION

U.S. Pat. No. 3,539,115 discloses a pump and a ball mill wherein rotational movement is imparted to a fluid medium by a powered impeller, causing a plurality of balls to roll about spaced shoulders on a stationary ball race assembly. Fluid circulation is provided from the area of the impeller, about the balls and through apertures in the ball race assembly to the area outward of the race assembly.

The present disclosure has structural features generally common to the pump and ball mill or hydraulic mill disclosed in U.S. Pat. No. 3,539,115. It functionally complements the utilization of the hydraulic mill described in that patent in that it creates maximum grinding pressure at the minimum flow rate through the assembly and maximum grinding rate at the maximum flow rate. In the previously disclosed unit, the maximum grinding rate and pressure required a high flow rate and the centrifugal forces created by the balls about the stationary ball race assembly were in direct relationship to the flow rate. In the present fluidic mill, the centrifugal forces are inversely proportional to the flow rate. This permits attainment of grinding pressures much greater than were previously available without increasing the size of the ball race assembly, the size of the balls or other rollers, or rotational speed.

SUMMARY OF THE INVENTION

The fluidic mill disclosed herein includes the combination of a rotating member having a split race assembly including an inwardly facing circular surface centered about its rotational axis, with apertures formed through the race assembly at the surface. A plurality of balls or rollers are arranged about the race assembly for rolling contact against the surface along at least two lines at opposite sides of the apertures. Means are provided for rotating the member and for directing fluid and material to the inner radial sides of the apertures, whereby the rolling movement imparted to the balls or rollers from the circular surface of the member will cause particles suspended in the fluid material to be ground under rolling pressure and urged radially outward through the apertures, where they can be recirculated or further processed.

It is a first object of this invention to provide a fluidic mill wherein centrifugal pumping forces are achieved in a fluid medium by rotation of a race assembly having freely rotatable balls or rollers positioned therein and including apertures for passage of the fluid medium radially outward through the race assembly.

Another object of this invention is to provide a fluidic mill capable of creating high grinding pressures at practical rotational speeds.

Another object of this invention is to provide a mechanical grinding apparatus capable of handling temperature-sensitive solid materials in a fluid suspension so as to assure heat dissipation without damage to the solid particles.

These and further objects will be evident from the following disclosure. Several variations and embodiments of the invention are illustrated and described, and many other further changes will be suggested to one skilled in the art.

DESCRIPTION OF THE DRAWINGS

FIG. 11 is a view similar to FIG. 3, showing a modified roller configuration; and FIGS. 12 through 19 schematically illustrate roller and race modifications.

DESCRIPTION OF THE PREFERRED EMBODIMENTS

Figure 7:
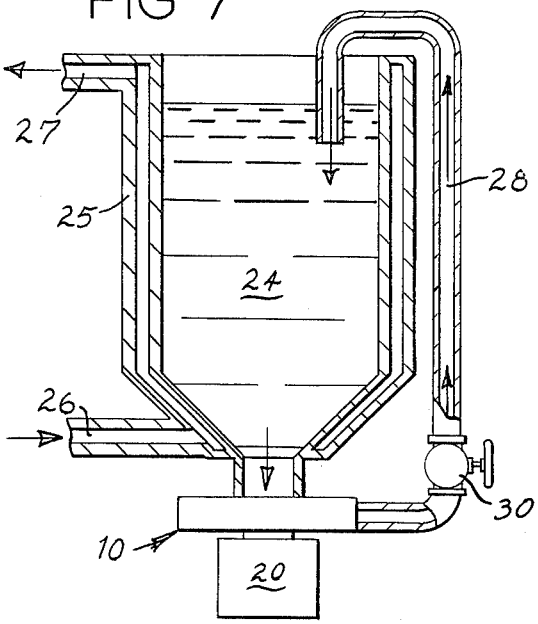
FIG. 7 is a schematic view of a first recirculating apparatus utilizing the fluidic mill.
Figure 8:
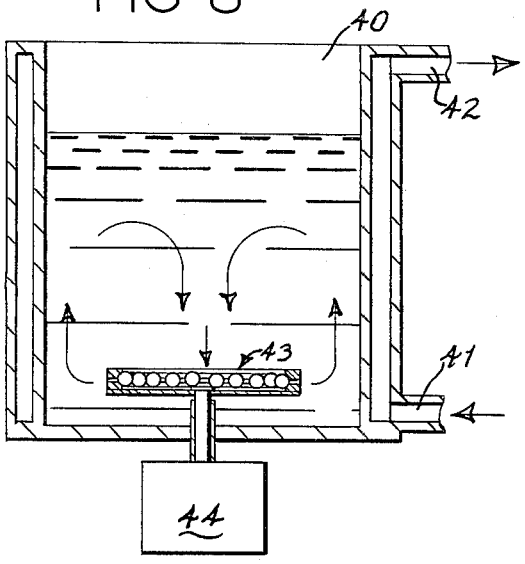
FIG. 8 is another schematic view showing a second recirculating apparatus.
Figure 9:
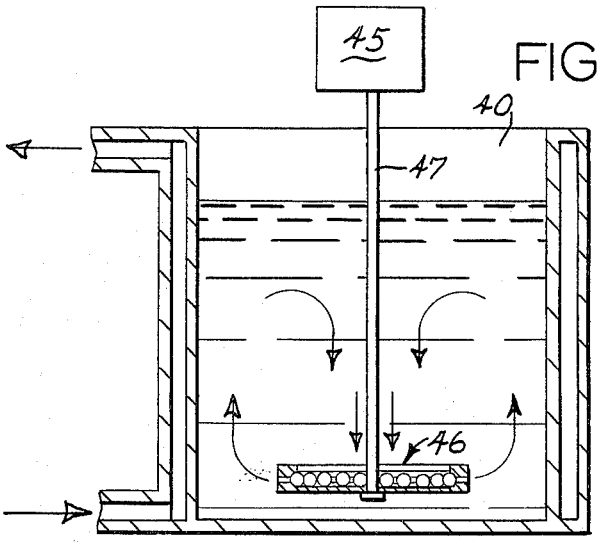
FIG. 9 is another schematic view showing a modified form of a recirculating apparatus as shown in FIG. 8.
Figure 10:
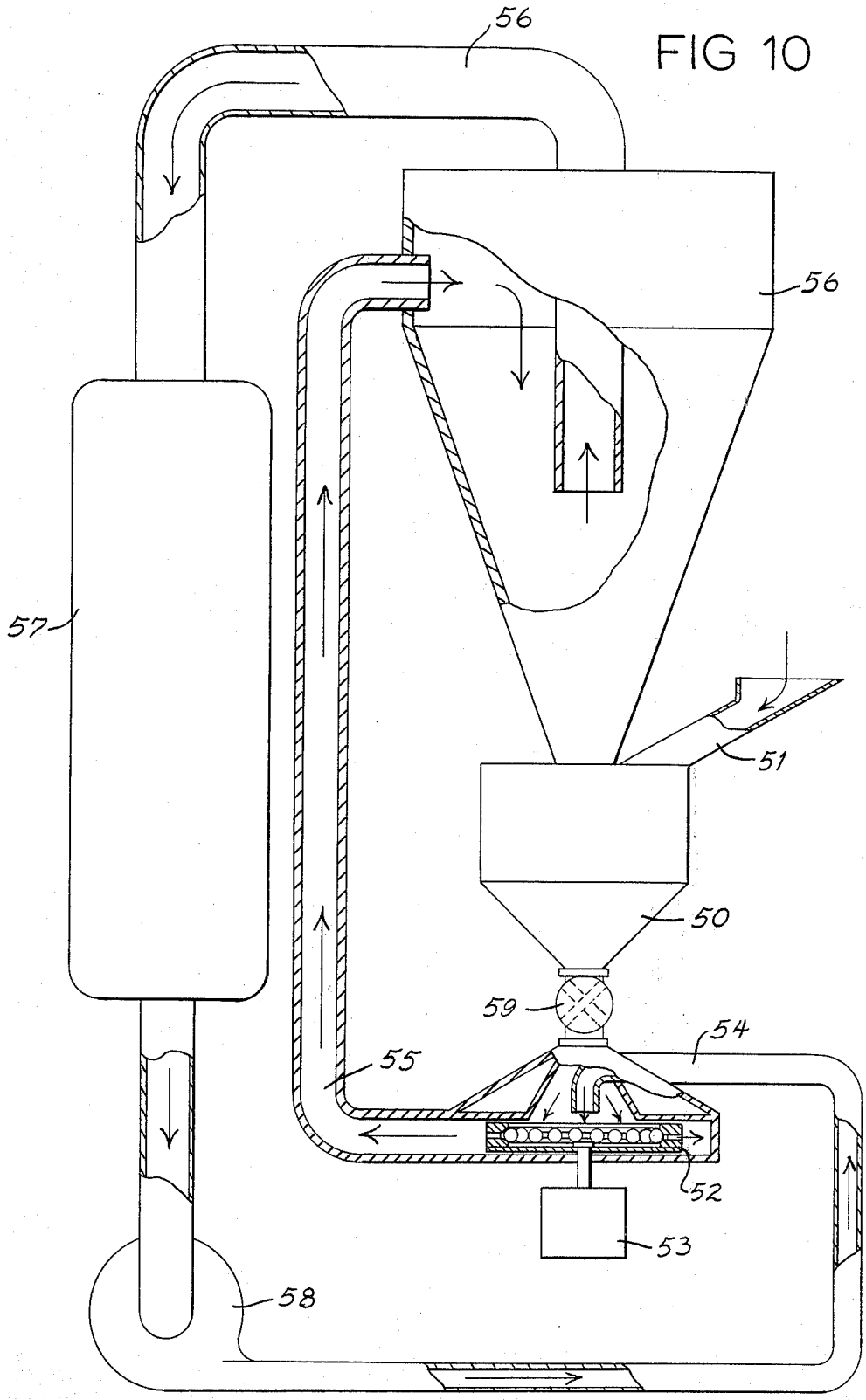
FIG. 10 is a somewhat schematic view showing a recirculating apparatus for the fluidic mill using air or gas as the fluid medium.

The apparatus shown in the drawings and referred to herein as a "fluidic mill" was designed specifically for use in carrying out the method of preparing suspensions of pesticides described in U.S. Pat. No. 2,957,803, although it is not limited to such applications. It is somewhat complementary to the utilization of the apparatus disclosed in U.S. Pat. No. 3,539,115, which teaches the use of split stationary races about which balls are rolled by the action of fluid and a powered central impeller. It differs from this prior apparatus in that the split races are themselves rotated to impart rotational and centrifugal forces to the balls or rollers and to the fluid medium. The fluidic mill is utilized to mechanically grind solid particles in a fluid suspension, whether the fluid medium is a liquid as shown in FIGS. 7–9, or a gas as shown in FIG. 10. FIGS. 1–10 show rollers in the form of spherical balls. FIGS. 11–19 illustrate other roller configurations.

The fluidic mill 10 as illustrated in FIGS. 1–4 is constructed by conversion of an existing centrifugal pump. However, the construction details of the fluidic mill are not limited to such conversions, and can incorporate special housings and other design configurations peculiar to this type of apparatus. When used externally in a fluid handling system where solid particles are to be ground while recirculating a fluid medium, the present apparatus leads itself well to utilization of the housing and power components of a centrifugal pump.

The fluidic mill includes a conventional volute illustrated generally in the drawings as comprising a fixed casing 11 and complementary inlet cover 12. An axial fluid inlet is shown at 14 and a tangential fluid outlet is shown at 13.

The apparatus is powered by a close coupled motor 20 that drives a central shaft 15 rotated about a central axis extending through the inlet 14. The race assembly unique to this disclosure is illustrated generally at 16 and is shown in detail in FIGS. 3 and 4. It is coaxially mounted on shaft 15 by a key or spline for rotation in unison with shaft 15. A circular retainer plate 17 overlaps the ball race assembly 16 and, together with assembly 16, is secured to shaft 15 by a lock screw 18.

Figure 3:
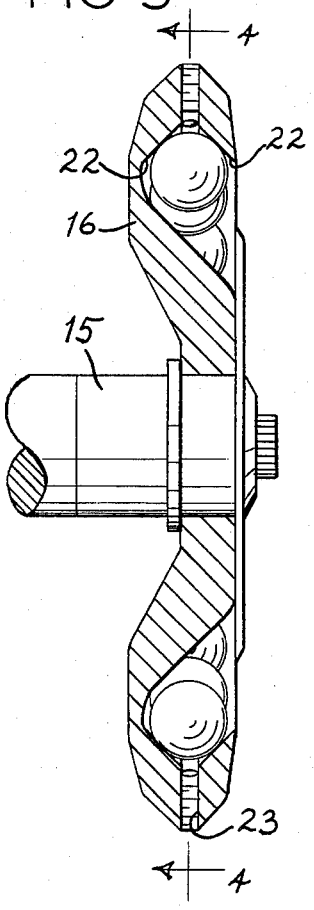
FIG. 3 is an enlarged vertical section taken through the ball race assembly of the fluidic mill.
Figure 5:
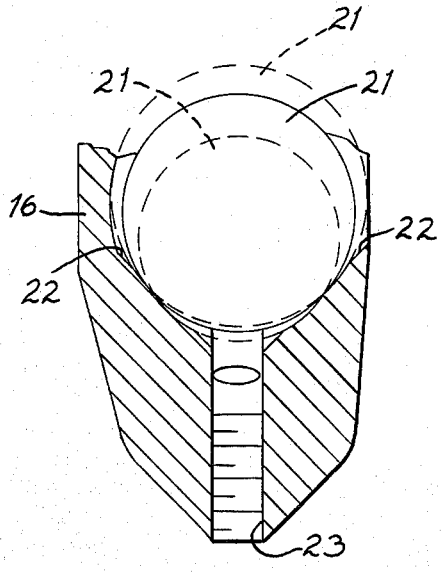
FIG. 5 is a vertical fragmentary sectional view through the ball race assembly, illustrating its adaptation to balls of varying diameter.

A plurality of spherical metal balls 21 are arranged freely about the race assembly 16, each ball being in unrestrained rolling engagement with annular surfaces 22 centered about the axis of shaft 15. The annular surfaces 22 are inclined inwardly to partially face one another. The lines of rolling contact between balls 21 and surfaces 22 are spaced axially relative to the shaft axis. The race assembly 16 further includes radial apertures 23 formed through the ball race assembly intermediate the lines of contact between the balls 21 and surfaces 22 (FIG. 3). Each aperture 23 is optionally threaded to selectively receive plugs (not shown) which may be threadably inserted in selected apertures to permit control of the flow of fluid through the race assembly 16 by reduction in the total aperture area about the ball race assembly 16.

Figure 1:
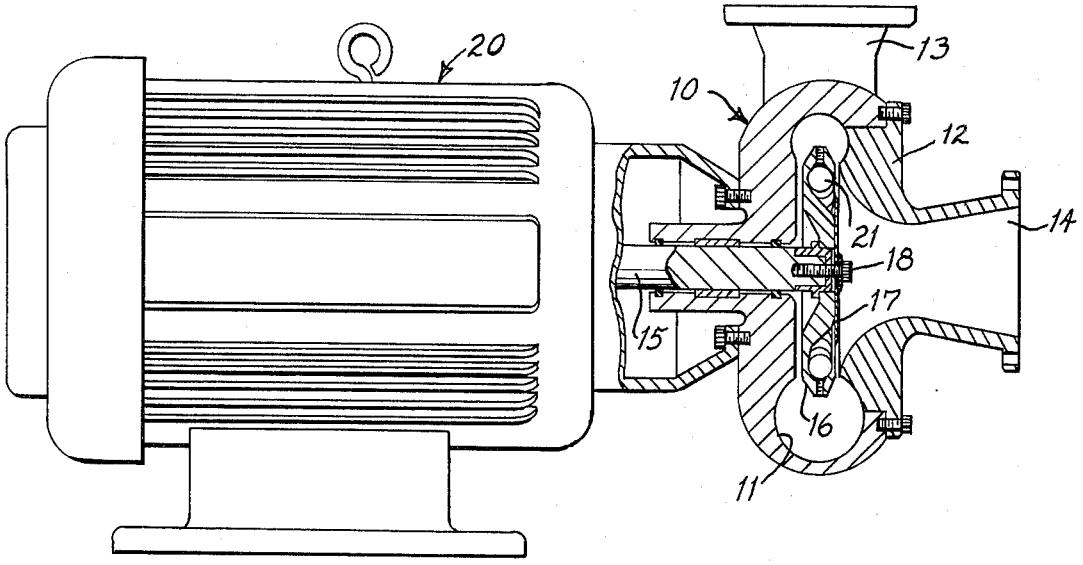
FIG. 1 is a side elevation of the fluidic mill coupled to a motor, with the mill shown in vertical section.
Figure 2:
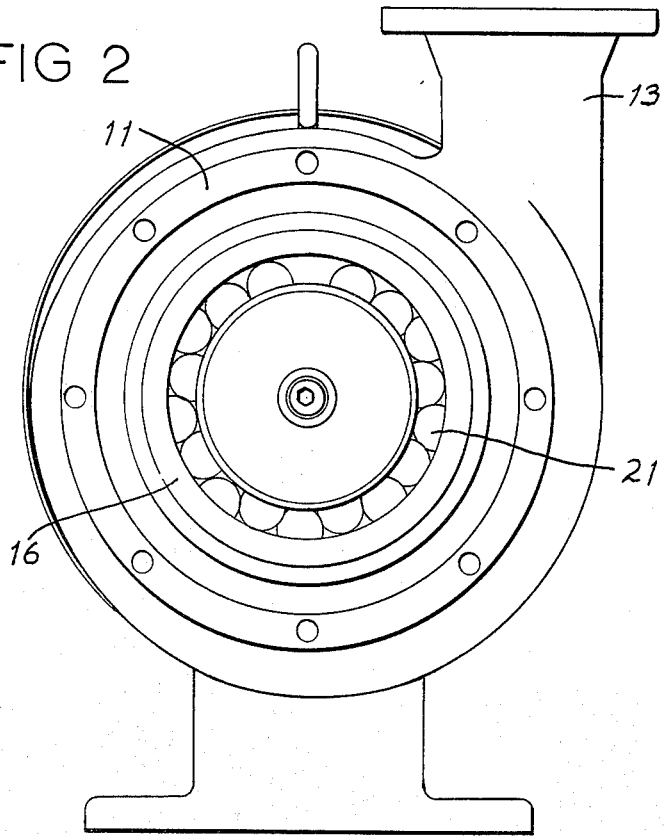
FIG. 2 is an enlarged end view of the fluidic mill as seen from the right in FIG. 1, with the inlet cover plates removed and mill shown at rest.
Figure 4:
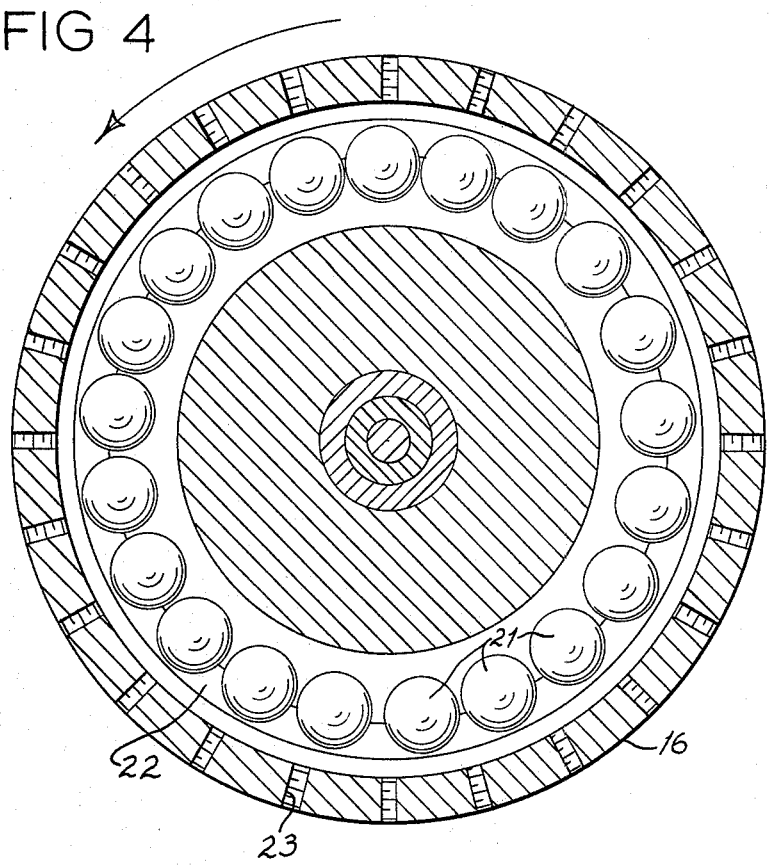
FIG. 4 is a sectional view through the ball race assembly as seen along line 4—4 in FIG. 3.

The apparatus can be used with the axis of shaft 15 in the horizontal position (FIGS. 1–4) or in the vertical position (FIGS. 6–9). When the shaft axis is in the horizontal position, it is necessary that a retainer be provided about the ball race assembly to prevent the balls from rolling out from within the race assembly when it is at rest. As described above, this is accomplished in the structure shown in FIGS. 1–4 by means of retainer plate 17. The maximum radial spacing between the outer edge of plate 17 and the radially adjacent inner edge of the surface 22 about the race assembly is less than the diameter of a single ball 21. When the race assembly 16 is at rest, the balls will tend to group as shown in FIG. 2. However, when the race assembly 16 is rotating, the single row of balls space themselves about the surfaces 22 in a relatively even fashion as shown in FIG. 4.

The fluidic mill is used to mechanically grind solid particles in a fluid medium. As an example, it can be used as shown in FIG. 7, where the inlet 14 is coupled to a gravity supply of liquid 24 in a jacketed tank 25. Cooling liquid can be supplied to the casing of tank 25 as indicated through an inlet 26 and outlet 27. The outlet 13 of the fluidic mill directs and pumps fluid and suspended ground particles through a return conduit 28 and back into tank 25.

In operation, the motor 20 rotates the race assembly 16, which imparts rolling movement to the balls 21 as well as rotational and centrifugal forces to the liquid 24 that comes in contact with the ball race assembly 16 and balls 21. The balls roll about the surfaces 22 in response to the resultant forces exerted on the balls due to rotation of the race assembly and the retardant forces exerted by the liquid 24. The liquid 24 and particles entrained in the liquid pass between the balls 21 and surfaces 22, where the particles are mechanically ground by the rolling contact between the metal balls and metal surfaces 22.

The fluidic mill acts as a pump, drawing fluid through inlet 14, passing it about the balls 21 and through the "split" races defined by surfaces 22, out through the apertures 23 and to the outlet 13. In this way, fluid and solid materials are continuously recycled and recirculated in the grinding apparatus.

The braking action of the fluid passing through the fluid area causes the balls to be slowed in their rotation about their own axes and therefore to rotate with the ball race assembly 16 about the axis of shaft 15, but at a speed slower than the powered rotational speed of the ball race assembly 16, about the shaft axis. The centrifugal forces on the balls created by their movement about the shaft axis causes them to exert a heavy pressure at the line of contact between each ball 21 and the two surfaces 22. It is the fact that the balls are moving at a slower speed than the ball race assembly with respect to the shaft axis that makes it possible to crush solid particles suspended in the fluid as the balls roll about their own axes.

The pressure of balls 21 against the surfaces 22 is a function of the centrifugal forces. The centrifugal forces on each ball 21 is a function of the coupling of the liquid 24 to the balls 21. The maximum centrifugal forces result at a hypothetical situation where there is no coupling and balls 21 travel in unison with the surfaces 22 about the shaft axis. The centrifugal forces are at a minimum with the balls 21 remaining stationary relative to the shaft axis during rotation of the surfaces 22. Obviously, neither hypothetical situation can occur in actual practice and with a given rate of rotation of the surfaces 22 and a given viscosity of the liquid or fluid 24, the centrifugal forces between the balls 21 and surfaces 22 will increase as the flow rate of the fluid is decreased and the centrifugal forces will decrease as the flow rate of the fluid is increased. Thus, the centrifugal forces between the balls 21 and surfaces 22 are inversely proportional to the flow rate of the fluid passing through the apparatus.

The rotational speed of balls 21 about the shaft axis will in practice range between the rotational speed of the race and one half the race speed unless slippage occurs between the balls and the race surfaces. Grinding pressure on the solid particles within the fluid can be controlled by adjusting the rate of flow of the suspension. This can be achieved by opening or closing selected apertures 23 about the ball race assembly 16 or by utilization of a valve 30 interposed to the return conduit 28 connected to outlet 13. By controlling the flow of fluid, one can increase or decrease the grinding pressure in a given situation.

Maximum grinding efficiency due to the rolling action of balls 21 about surfaces 22 is assured by continuing line contact between these elements. The surfaces 22 and balls 21 should each be hardened metal for long life. The surfaces 22 are initially conical, but will gradually wear along circular grooves due to contact with balls 21. Longer ball race life can be achieved by utilizing balls of differing diameters (FIG. 5) so that the balls of each size will engage surfaces 22 along spaced circular lines of contact. This will eventually result in the formation of multiple grooves about the surfaces 22, but will effectively lengthen ball race life.

Figure 6:
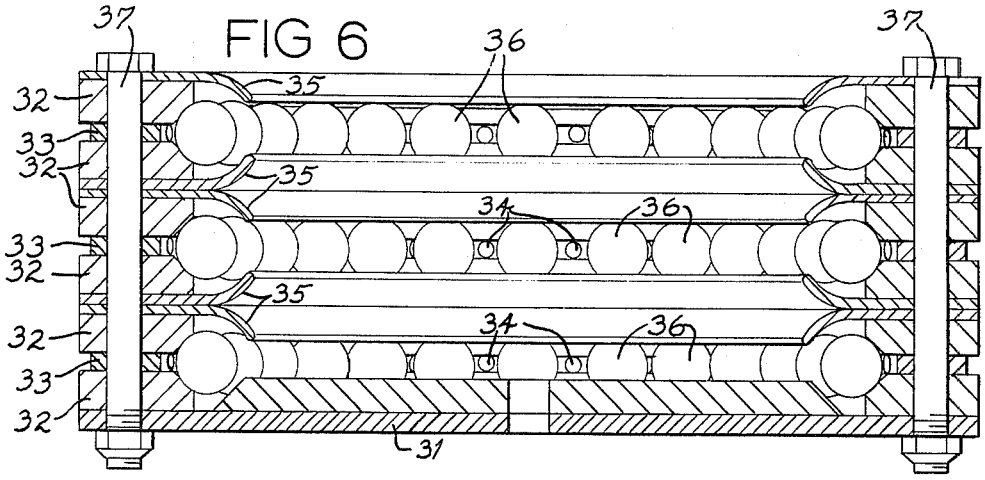
FIG. 6 is a vertical sectional view through a modified ball race assembly.

FIG. 6 shows a modified form of the invention wherein several ball races are stacked axially to increase the total area of contact in the unit between the balls and ball race surfaces. The modified fluidic mill includes a horizontal disk 31 adapted to be fixed at its center to a rotating powered shaft (not shown). Paired groups of circular ball races 32 are stacked on disk 31, with intermediate annular spacers 33 having apertures 34 formed radially through the spacers. Annular retaining disks 35 have inwardly bent rims that prevent the respective rows of balls 36 from dropping out from the area of the races when the fluidic mill is not in use. The disks 35, spacers 33 and ball races 32 are illustrated as being held to disk 31 by elongated bolts 37. The illustrated multiple unit can be used in either a vertical or horizontal position.

It is not necessary that the fluidic mill be utilized within a centrifugal pump housing or within any specific housing. FIGS. 8 and 9 show the fluidic mill in the interior of a larger tank or reservoir 40. The tank 40 has a cooling jacket having an inlet at 41 and an exit at 42. The fluidic mill, shown generally at 43, draws liquid downwardly at its center and propels it radially outward about the circumference of the apertured ball races. In this way, liquid and suspended solid particles are continuously agitated by the action of the mill and the particles are ground as the conveying liquid passes through the vicinity of the balls. In FIG. 8 the motor 44 is external of tank 40 and located beneath its lower wall. In FIG. 9 motor 45 is above the tank, with the fluidic mill 46 suspended within the tank by an elongated shaft 47.

FIG. 10 schematically illustrates one manner by which the fluidic mill can be utilized with gas or air as the conveying medium for the solid particles to be ground. Solid particles are initially delivered into the system through an inlet 51 on a holding tank 50. The solid material stacked within tank 50 is discharged through an air lock 59 aligned axially above the fluidic mill 52 powered by motor 53. Conveying air is delivered to the fluidic mill 52 by a supply conduit 54 that also has a discharge axially aligned above the fluidic mill 52. The air and particles then pass through the fluidic mill, permitting the particles to be ground by rolling contact of the balls about the races prior to passage of the particles and conveying gas medium through the apertured ball faces. The exiting air and particles are received through a conduit 55 directed to the inlet of a cyclone separator 56 which causes particles of a chosen design size to be discharged downwardly into holding tank 50. Smaller particles and the conveying air are received through exit conduit 56, which leads to a filter or separator 57 that collects the ground particles. The recirculating air is then directed to a pump 58 leading to the supply conduit 54. In this way the air within the system is continuously recycled and used solely by a conveying medium for the solid particles granted by the fluidic mill.

FIG. 11 is similar to FIG. 3, illustrating the application of specially designed rollers in this combination. While spherical balls have been proved effective in operation of the fluidic mill as shown in detail in FIGS. 1–5, measurable wear caused by rubbing of adjacent balls does develop about the ball surfaces. Each ball forms a single rotational axis and develops a cylindrical wear surface centered about this axis. The wear surface reduces the effective diameter between the adjacent balls, spacing the balls about the race surface areas. This requires periodic ball replacement to minimize relative movement between the balls as they rotate about the split race surfaces.

FIG. 11 illustrates the preferred configuration of rollers 60, which roll about a modified race assembly 61 mounted to the previously described shaft 15. Each roller 60 includes a center section 62, which is cylindrical and centered about a roller axis shown by the line R-R. Tapered sections 63 extend outward from the center section 62 at each side of the roller. Each is formed as the frustum of a cone centered along the axis R—R. The maximum diameter of each tapered section 63 is less than the diameter of the center section 62, leaving a radial shoulder 64 at each side of the center section 62. The circular end surfaces 65 formed on each roller 60 are planar and perpendicular to the axis R—R.

The race assembly 61 is formed with annular surfaces 66 that are tapered to complement the rolling surfaces along sections 63. The matching tapers of surfaces 66 and sections 63 serve to center each roller 60 between the annular surfaces 66. The enlarged center section 62 of the roller is received within an annular groove 67 that is formed between the surfaces 66. The axial width of groove 67 is slightly greater than the width of the center section 62 across each roller 60, and the depth of groove 67 is greater than the depth of the shoulder 64. Groove 67 therefore provides physical clearance between the center section 62 of each roller and the race assembly 61 so that no rubbing or rolling occurs between these elements. Rolling contact between each roller 60 and the race assembly 61 is confined to the overlapping portions of the side sections 63 and surfaces 66.

The race assembly 61 is apertured between surfaces 66, each aperture 68 extending from the outside cylindrical surface of race assembly 61 to the interior of groove 67. A retaining plate 69 is fixed to the race assembly 61 to assure retention of rollers 60 in an operative position when the race assembly is at rest. The annular surfaces 66 are shown with reliefs machined along their outer extremities as shown at 70. This permits a reasonable amount of wear along surfaces 66 without any rubbing between the rollers 60 and race assembly 61.

The rollers 60 are preferably constructed of material that is harder than that of race assembly 61, although they can be made of the same material. The enlarged center section 62 on each roller is designed to accommodate wear between adjacent rollers without any modification to the rolling surfaces. This is assured because the center sections 62 are of substantially greater diameter than the diameter of the rolling surfaces. Therefore, the life of individual rollers 60 is substantially greater than in the case of the unit using spherical balls. To minimize movement between adjacent rollers 60, individual rollers are selectively replaced as the center sections 62 are reduced in diameter. By using a progression of diameters in the rollers 60 about their center sections 62, one can maintain minimum roller spacing by periodically replacing the worn rollers of least diameter. While all of the rollers will have identical rolling diameters along the section 63, they can vary in diameter at the center sections 62.

While the roller construction shown in FIG. 11 has been found to be particularly well suited to the needs of this device, other roller and race shapes can be used. A series of rollers and race surfaces are illustrated schematically in FIGS. 12–19. Those with tapered rolling surfaces (FIGS. 12, 13, 15, 17 and 19) assure self centering of the rollers about the race assembly. Those having cylindrical rolling surfaces (FIGS. 14, 16 and 18) would require some rubbing guidance of the rollers and are probably less desirable for this reason. Curved rolling surfaces (FIGS. 13 and 19) are more difficult to machine and maintain, but are not impractical.

The diameter of the rollers can be varied to meet the grinding requirements of a particular solid substance. The diameter of the rolling surfaces can be enlarged or made smaller than as in FIG. 11 without changing the configuration of the race assembly 61, so long as the same angular relationship of the roller sections are maintained. With smaller rollers or balls, there is less weight and therefore less centrifugal force due to rotation of the rollers or balls. The surface engagement between the rollers or balls and the surfaces of the race assembly more closely approach a theoretical line contact. Larger diameter rollers or balls present a flatter approach to the race surfaces and therefore have less grinding leverage than the smaller diameter elements.

For purposes of this disclosure, the term "ball means" shall denote spherical balls as illustrated in FIGS. 1–4, as well as cylindrical rollers, as shown in FIG. 16, rollers having straight tapered surfaces, as shown in FIGS. 11, 12, 15 and 17, or curved tapered surfaces, FIGS. 13 and 19. Such rollers may or may not include an enlarged center section.

Many further modifications might well be made in the basic structure of this disclosure without deviating from the concepts set out herein. For these reasons, only the following claims are intended as definitions of my invention.

Having thus described our invention, We claim:

1. A fluidic mill for pumping a fluid material carrying solid particles through the mill and grinding the solid particles as the material is pumped through the mill, comprising:

an annular outer race rotatable about a center axis;

said outer race having two axially spaced annular grinding surfaces inwardly facing the center axis;

a plurality of grinding ball means arranged about the outer race in rolling contact with said grinding surfaces;

means operatively connected to the outer race for rotating the outer race in a desired rotational direction about the center axis;

each of said ball means being mounted to freely rotate in the same direction as the outer race about the center axis;

operative means in open communication through the annular race intermediate the grinding surfaces for permitting passage of material radially outward through the race;

means for directing said fluid material into the mill and directing the fluid material centrifugally outward against the ball means and between the ball means and the grinding surfaces and through the aperture means, thereby retarding the rotational movement of the ball means in the desired rotational direction about the center axis in proportion to the flow rate of the material through the mill, with the centrifugal pressure of the ball means against the grinding surfaces being inversely proportioned to the flow rate of the material through the mill.

2. The fluidic mill as defined in claim 1 wherein the ball means comprises spherical balls having ball centers and wherein the spherical balls are in line contact with the outer race grinding surfaces along planes displaced from the ball centers.

3. The fluidic mill as defined in claim 1 wherein the outer race grinding surfaces face each other and are conical in shape.

4. The fluidic mill as defined in claim 1 wherein the aperture means comprises a plurality of apertures angularly spaced about the central axis between the grinding surface and extending radially outward through the outer race.

5. The fluidic mill as defined in claim 1 wherein the annular grinding surfaces are tapered toward each other and wherein the ball means have rolling surfaces complementary to the tapered grinding surfaces for grinding the solid particles therebetween.

6. The fluidic mill as defined in claim 5 wherein the outer race has an annular groove between the grinding surfaces communicating with the aperture means.

7. The fluidic mill as defined in claim 6 wherein the ball means has an enlarged center section having a diameter greater than the rolling surfaces that projects and rides in the groove as the ball means are rotated about the center axis.

8. The fluidic mill as defined in claim 1 wherein the ball means each have rolling surfaces that are complementary to and engaging the annular race surfaces for grinding solid particles therebetween.

9. The fluidic mill as defined in claim 1 wherein the outer race has an annular groove formed therein and wherein each ball means includes an enlarged center section projecting into and riding in the groove as the ball means is rotated for engaging adjacent ball means and limiting wear between the adjacent ball means.

* * * * *